US008011419B2

(12) United States Patent
Cieplewski et al.

(10) Patent No.: US 8,011,419 B2
(45) Date of Patent: Sep. 6, 2011

(54) MATERIAL USED TO COMBAT THERMAL EXPANSION RELATED DEFECTS IN THE METAL CASTING PROCESS

(75) Inventors: Jeffrey Jon Cieplewski, Waukesha, WI (US); Andrew Callan, Wauwatosa, WI (US); Rebecca Roti, Wauwatosa, WI (US)

(73) Assignee: IGC Technologies, LLC, Milwaukee, WI (US)

( * ) Notice: Subject to any disclaimer, the term of this patent is extended or adjusted under 35 U.S.C. 154(b) by 576 days.

(21) Appl. No.: 12/243,561

(22) Filed: Oct. 1, 2008

(65) Prior Publication Data

US 2009/0090485 A1 Apr. 9, 2009

Related U.S. Application Data

(60) Provisional application No. 60/977,160, filed on Oct. 3, 2007.

(51) Int. Cl.
*B22C 1/02* (2006.01)
*B22C 1/08* (2006.01)
*B22C 9/02* (2006.01)

(52) U.S. Cl. ..... 164/520; 164/523; 164/529; 164/138; 106/38.2; 106/38.9

(58) Field of Classification Search ..... 164/520, 164/523, 528, 529, 138; 106/38.2, 38.22, 106/38.27, 38.9
See application file for complete search history.

(56) References Cited

U.S. PATENT DOCUMENTS

| | | | | |
|---|---|---|---|---|
| 2,818,620 | A | 1/1958 | Moore | |
| 4,264,052 | A | 4/1981 | Radtke et al. | |
| 4,345,003 | A | 8/1982 | Matsushima et al. | |
| 4,347,890 | A | 9/1982 | Ailin-Pyzik et al. | |
| 4,514,227 | A | 4/1985 | Szabo | |
| 4,594,105 | A | 6/1986 | Grimm et al. | |
| 5,057,155 | A | 10/1991 | Nakayama et al. | |
| 5,911,269 | A | 6/1999 | Brander et al. | |
| 6,391,942 | B1 | 5/2002 | Chang et al. | |
| 6,972,302 | B2 | 12/2005 | Baker et al. | |
| 7,938,169 | B2 * | 5/2011 | Attridge et al. | 164/520 |
| 2005/0258405 | A1 | 11/2005 | Sayala | |
| 2009/0114364 | A1 * | 5/2009 | Cieplewski et al. | 164/529 |
| 2009/0114365 | A1 * | 5/2009 | Cieplewski et al. | 164/529 |

OTHER PUBLICATIONS

International Search Report for PCT/US08/078480 filed Oct. 1, 2008; mailed Dec. 23, 2008.

* cited by examiner

*Primary Examiner* — Kevin P Kerns
(74) *Attorney, Agent, or Firm* — Brian G. Gilpin; Godfrey & Kahn, S.C.

(57) ABSTRACT

Thermal expansion defects, i.e. veining, are reduced in iron, steel, and nonferrous castings by adding a lithia-containing material in a sufficient amount to the silica sand mold. Adjusting current formulations to maximize the use of lesser expensive raw materials and minimize the use of more expensive raw materials to lower the overall percentages of lithia/metallic oxide containing additives while still reducing or eliminating thermal expansion related defects in the metal casting process reduces the overall cost to manufacture the product.

4 Claims, 1 Drawing Sheet

MATERIAL USED TO COMBAT THERMAL EXPANSION RELATED DEFECTS IN THE METAL CASTING PROCESS

CROSS REFERENCE TO RELATED APPLICATIONS

This application claims the benefit of provisional U.S. Application No. 60/977,160, filed Oct. 3, 2007, which is specifically incorporated herein by reference under 35 U.S.C. §119(e).

FIELD OF THE INVENTION

The present invention relates to metal founding, and more particularly to a method of making a sand-based mold which improves the quality of castings by including a material which reduces veining defects. Said material provides for a lower overall cost to manufacture the product by adjusting the formulation to maximize the use of less expensive raw materials and minimize the use of more expensive raw materials.

BACKGROUND OF THE INVENTION

Iron oxides have been used for years in foundry applications to improve core properties and the quality of castings. Iron oxides have proven to be advantageous as an additive to foundry molding aggregates containing silica sand to improve the quality of castings by reducing the formation of thermal expansion defects, such as veining, scabs, buckles, and rat tails as well as gas defects, such as pinholes and metal penetration. There are several iron oxides which are currently used in foundries today. These include red iron oxide, also known as hematite ($Fe_2O_3$), black iron oxide, also known as magnetite ($Fe_3O_4$) and yellow ochre. Another iron oxide which is presently being used is Sierra Leone concentrate which is a hematite ore black in color. Red iron oxide and black iron oxide are the most popular iron oxides in use.

The currently accepted method of employing the above iron oxides is to add approximately 1-3% by weight to the sand mold aggregates during mixing. The exact mechanism by which iron oxides affect surface finish is not totally understood. However, it is generally believed that the iron oxides increase the hot plasticity of the sand mixture by the formation of a glassy layer between the sand grains which deforms and "gives," without fracturing at metallurgical temperatures, to prevent fissures from opening up in the sand, which in turn reduces veining.

Various other types of additives have also been employed in an attempt to improve core properties and the quality of sand castings. For example, other anti-veining compounds which have been used in sand aggregate mixtures include starch based products, dextrin, fine ground glass particles, red talc and wood flour, i.e. particles of wood coated with a resin. All of these additives have met with limited success in reducing veining.

Currently, minerals containing lithia are utilized in the glass, glaze, and enamel industries as a fluxing agent. Also, in Nakayama et al, U.S. Pat. No. 5,057,155, a lithium mineral is added to a mold-forming composition to function as an expansive agent during heating and firing of ceramic molds used in the investment casting industry. According to Nakayama et al, the mold-forming composition irreversibly expands during firing of the mold in proportion to the amount of lithium mineral present to provide dimensional accuracy for castings by compensating for solidification shrinkage which occurs during cooling of poured metals such as titanium and the like used, for example, in dental castings. However, Nakayama et al fails to teach using a lithia-containing compound such as α-spodumene as an anti-veining agent in sand-based foundry molding and core mixtures.

U.S. Pat. No. 5,911,269 to Brander et al., which is incorporated herein by reference, teaches a method of making a silica sand-based foundry mold wherein thermal expansion defects, i.e. veining, are reduced by adding a lithia-containing material in a sufficient amount to the silica sand mold to provide about 0.001% to about 2.0% of lithia, wherein the addition of lithia is accomplished by adding lithium bearing minerals. A sand-based aggregate of silica sand, binder, and lithia-containing material is disclosed, where the silica sand comprises from about 80% to about 90% of the aggregate, the binder contains about 0.5-10% of the aggregate, and the lithia-containing material provides from about 0.001% to about 2.0% of lithia. The addition of lithia is accomplished by adding lithium bearing materials such as α-spodumene, amblygonite, montebrasite, petalite, lepidolite, zinnwaldite, eucryptite or lithium carbonate.

A specific formulation of a lithia additive as disclosed in Brander et al. was developed, and is commercially known as "Veinseal 14000." The formulation for Veinseal 14000 is: 68.00% lithia-based material; 7.00% metallic oxide; 25.00% "filler material." The filler material is $TiO_2$-containing ilmenite. The Veinseal 14000 product is an effective anti-veining agent that is used at a minimum effective concentration of about 5% based on sand weight (B.O.S.) of the sand cores.

U.S. Pat. No. 6,972,302 to Baker et al. teaches an anti-veining material comprising less than about 4% by weight of a lithia-containing material, and at least about 1% by weight of ferric oxide ($Fe_2O_3$), with the anti-veining material preferably comprising 2.5% $Li_2O$, 10-25% of $TiO_2$, 15-25% $Al_2O_3$, 10-25% of $Fe_3O_4$, and 60-70% of $SiO_2$ mixed with about 1% by weight of $Fe_2O_3$, preferably red iron oxide. In Baker et al., thermal expansion of sand cores and unwanted veins in the metal casting formed thereby are substantially eliminated with the use of less than 4% by weight of lithia-containing anti-veining agents, such as the Veinseal 14000 product, combined with the use of an effective amount of ferric oxide ($Fe_2O_3$), at least about 1% by weight, thereby reducing the quantity of lithia-containing anti-veining agent needed by adding ferric oxide, resulting in a reduction in cost without a decrease in the quality of the castings.

Veinseal 14000 is an expensive product due to the high cost of the lithia material, and its use in such large concentrations results in a product that is very costly to the manufacturers of the cores. Some of the raw materials, namely the lithia and metallic oxide, are more costly to obtain, while the filler materials are much more inexpensive. Accordingly, a need exists to improve the performance and functionality of the existing lithia/metallic oxide containing formulations by reducing the overall cost to manufacture the product by adjusting the formulations to maximize use of the lesser expensive raw materials and minimize use of the more expensive raw materials. It would also be beneficial to reduce or eliminate thermal expansion related defects in the metal casting process.

SUMMARY OF THE INVENTION

The present invention relates to a method of making silica sand mold and core aggregates utilizing lithium-containing additives and to the composition of such additives. The lithium-containing additive provides a source of lithia ($Li_2O$). The additive is mixed with foundry sand molding and core aggregates to improve the quality of castings by reducing thermal expansion defects, i.e. veining, in iron, steel, and non-ferrous castings. Typically, the mold or core mixture may comprise between about 80% to about 99% of silica sand, and about 0.5% to about 10% of a binder. The additive of the present invention is a lithia-containing additive added in sufficient amount to the aggregate to provide about 0.001% to about 2.0% of lithium oxide ($Li_2O$) commonly referred to as Lithia.

The performance and functionality of existing lithia/metallic oxide containing formulations is improved by reducing the overall cost to manufacture the product by adjusting the formulations to maximize use of the lesser expensive raw materials and minimize use of the more expensive raw materials. The use of such an additive has been found to be effective to reduce or eliminate thermal expansion related defects in the metal casting process.

The present invention has several advantages and benefits over the prior art. Other objects, features and advantages of the present invention will become apparent after viewing the following detailed description.

DETAILED DESCRIPTION OF THE INVENTION

Figure 1:
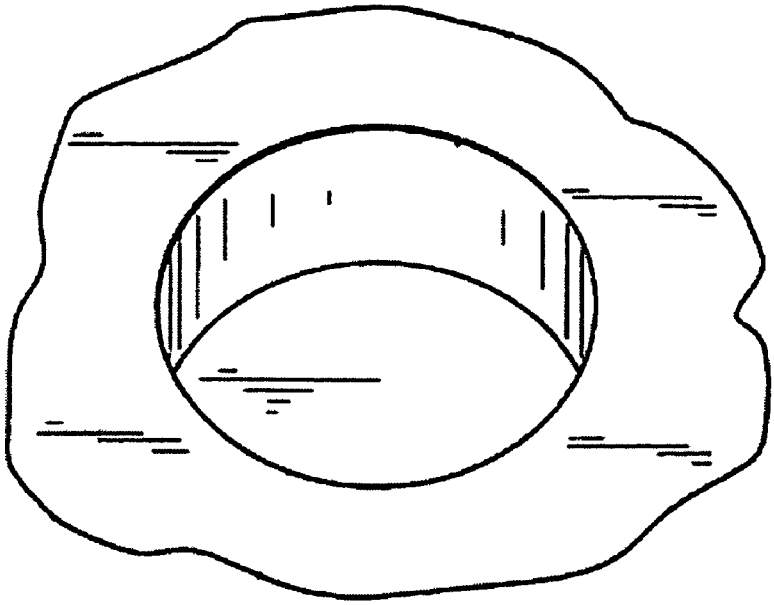
FIG. 1 is a perspective view of a test casting illustrating the results of the use of a lithia/metallic oxide containing material in accordance with the present invention to produce a sand mold with a rating of "0," free of veining defects.

An additive to foundry sand molding and core aggregates is used to produce sand cores and molds. The additive produces a sand-based foundry molding and core aggregate which resists the formation of some of the defects commonly associated with the production of castings produced by silica sand-based molding and core aggregates. In particular, the additive improves the quality of castings by reducing thermal expansion defects, i.e. veining, in iron, steel and non-ferrous castings.

The additive of the present invention may be used with conventional foundry silica sand molding and core aggregates used in the manufacture of sand-based molds and cores. Such mold and core aggregates are usually made from silica sand, with the sand grains being bound together with a mechanical or chemical means. Typically, the mold or core mixture may comprise between about 80% to about 99% of silica sand, and about 0.5% to about 10% of a binder. The binder used may be any of numerous conventional core and mold binder systems such as phenolic hot box, phenolic urethane, furan, sodium silicate including ester and carbon dioxide system, polyester binders, acrylic binders, alkaline binders, epoxy binders, and furan warm box systems. Each of the above binder systems is well known in the art and therefore a detailed description thereof is unnecessary.

The additive of the present invention is a lithia-containing additive added in a sufficient amount to the aggregate to provide about 0.001% to about 2.0% of lithium oxide ($Li_2O$) commonly referred to as lithia. As taught by Brander et al., with less than about 0.001% lithia, the additive becomes less effective resulting in a significant increase in veining and metal penetration. The addition of lithia to the aggregate is accomplished by adding lithia from a material such as α-spodumene, amblygonite, montebrasite, petalite, lepidolite, zinnwaldite, eucryptite or lithium carbonate. Each of these materials is a lithia source and may be employed depending upon the particular sand-based aggregate and binder system being utilized. All of the above-described lithia sources are commercially available and typically contain about 3% to about 10% lithia with the exception of lithium carbonate which has about 40% lithia. The current formulation for the prior art, the Veinseal 14000 product in a commercially available embodiment, is: 68.00% lithia-based material; 7.00% Metallic Oxide; 25.00% "filler material."

The preferred new formulation for the lithia-based additive, hereinafter referred to as "02-050," is as follows:

52.75% Lithia-based material; 22.75 Black Iron Oxide; 5.00% Red Iron Oxide; 19.50% "filler material"

This 02-050 formulation contains only 52.75% of the lithia-based material, as compared to the 68.00% in the prior art Veinseal 14000 product. Given the high cost of Veinseal 14000, this reduction is a substantial benefit. In addition, the experiments described below demonstrate that a 3.5% based on sand weight (B.O.S.) percentage of 02-050 used in the aggregate, which is less than the minimum 5% B.O.S. of Veinseal 14000 currently commercially used, produces equally effective results. Testing revealed that the use of less than 3.0% B.O.S. 02-050 resulted in increased veining defects. Some unique casting configurations or extraordinary casting environments may require more than 3.5% B.O.S. 02-050 to achieve the desired defect-free castings.

The preferred lithia-based material used for the 02-050 material is spodumene. Spodumene is a lithium aluminum silicate having the formula $Li_2O—Al_2O_3\text{-}4SiO_2$. Spodumene offers a high amount of lithia to the formulation as compared to other lithia-containing minerals (i.e. Lepidolite, Amblygonite). Also, spodumene is generally more commercially available than other lithia-containing minerals. Lithium is the lightest, smallest and most reactive of the alkali metals. In addition, lithium possesses the smallest ionic radius and the highest ionic potential. These factors combine to produce an extremely powerful flux.

The preferred "filler material" is ilmenite. Ilmenite has the formula $FeO—TiO_2$. Ilmenite is a source of titanium dioxide ($TiO_2$), which is widely used in ceramic glazes. Iron oxide is used to improve the surface finish of the cast metal pieces. The melting points of the minerals in this formulation are as follows: spodumene=2588° F.; ilmenite=2489° F.; black iron oxide=2498° F.; red iron oxide=2849° F.

The synergistic effect of the combination of the minerals in 02-050 fluxes, or softens, at or just below the pouring temperatures of molten iron (2450° F.-2750° F.). The resultant "substance" formed is a material high in viscosity that allows for the thermal expansion of chemically bonded sand to occur without jeopardizing the surface integrity of the sand core used in the casting process. The 02-050 material thus adds "plasticity" to a rigid sand core, allowing it to move without cracking.

Figure 2:
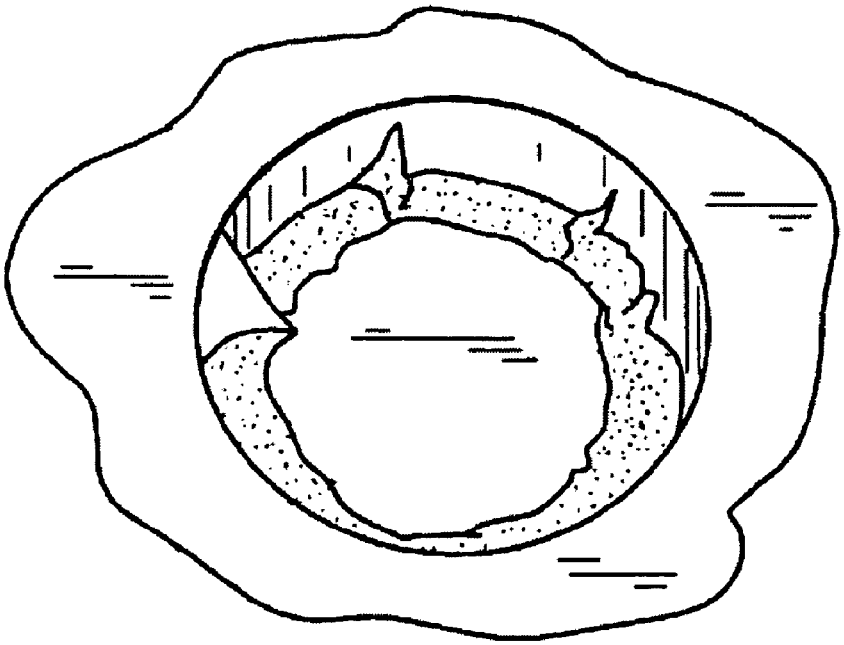
FIG. 2 is a perspective view of a test casting illustrating the results of a sand mold with a rating of "5," having massive veining/penetration.

To test the new formulation, small sample cylindrical cores were prepared. The samples were prepared for testing and illustration purposes only. Standard sand batch preparation is a blend of 1500.00 grams Badger 55 sand, 1.20% B.O.S. of a phenolic urethane resin system as a binder, and 3.5% B.O.S. of the 02-050 anti-veining additive sand. The mixture is formed into a cylindrical rod (a core) as illustrated in FIGS. 1 and 2, with a diameter of 2 inches and a height of 2 inches. Variations to the sand preparation can be made to evaluate the impact of the sand additive on certain characteristics such as core tensile strengths and binder levels.

The manufactured cores are then placed in a sand mold and sent through the metal casting process. The resultant castings include cylindrical cavities whose cylindrical surfaces are characterized by the amount of veining (thermal expansion defects) present.

The ratings provided below for the results of each sample are based on visual observations of the surface finish of the test castings, and the lower number the better or more improved the quality of the casting. The ratings are based on the following legend:

0=No veining/no penetration

1=Slight veining and/or slight penetration

2=About 25% of core area contains veining and/or penetration

3=About 50% of core area contains veining and/or penetration

4=About 75% of core area contains veining and/or penetration

5=Massive veining and/or penetration

Experiment

The experiment utilized three sample formulations: Samples 1-3 were the control cores, containing no additive; Samples 4-6 used the prior art Veinseal 14000 product; and Sample 7-9 utilized the new 02-050 formulation for the additive. Table 1 summarizes the results of the experiment.

Sample 1:

1500.00 grams Badger 55 sand blended with 1.20% B.O.S phenolic urethane resin system. No lithia-containing additive was added to the aggregate. The resulting casting showed obvious thermal expansion defects (veining) noted throughout the entire casting cavity, similar to that illustrated in FIG. 2. The rating for this casting is 5.

Sample 2:

1500.00 grams Badger 55 sand blended with 1.20% B.O.S phenolic urethane resin system. No lithia-containing additive was added to the aggregate. The resulting casting again showed obvious veining noted throughout the entire casting cavity. The rating for this casting is 5.

Sample 3:

A third sample with 1500.00 grams Badger 55 sand blended with 1.20% B.O.S phenolic urethane resin system. No lithia-containing additive was added to the aggregate. The resulting casting again showed obvious veining noted throughout the entire casting cavity. The rating for this casting is 5.

Sample 4:

1500.00 grams Badger 55 sand blended with 1.20% B.O.S phenolic urethane resin system blended with 5.00% B.O.S. Veinseal 14000. The resulting casting revealed a casting cavity free of veining defects. The rating for this casting is 0, as that illustrated in FIG. 1.

Sample 5:

1500.00 grams Badger 55 sand blended with 1.20% B.O.S phenolic urethane resin system blended with 5.00% B.O.S. Veinseal 14000. Again, the resulting casting revealed a casting cavity free of veining defects. The rating for this casting is 0.

Sample 6:

A third sample with 1500.00 grams Badger 55 sand blended with 1.20% B.O.S phenolic urethane resin system blended with 5.00% B.O.S. Veinseal 14000. The resulting casting revealed a casting cavity with slight veining defects. The rating for this casting is 1.

Sample 7:

1500.00 grams Badger 55 sand blended with 1.20% B.O.S phenolic urethane resin system and 3.50% B.O.S. 02-050. The results revealed casting cavity free of veining defects. The rating for this casting is 0. Veining-free casting surfaces similar to those surfaces obtained using 5.00% Veinseal 14000 were achieved using the 02-050 sand additive.

Sample 8:

Another sample testing the 02-050 formulation, again using 1500.00 grams Badger 55 sand blended with 1.20% B.O.S phenolic urethane resin system and 3.50% B.O.S. 02-050. The results again revealed casting cavity free of veining defects. The rating for this casting is 0.

Sample 9:

A third sample using 1500.00 grams Badger 55 sand blended with 1.20% B.O.S phenolic urethane resin system and 3.50% B.O.S. 02-050. Again, the results revealed casting cavity free of veining defects. The rating for this casting is 0. As also revealed in Samples 7 and 8, veining-free casting surfaces similar to those surfaces obtained using 5.00% Veinseal 14000 were achieved in this sample using the 02-050 sand additive.

TABLE 1

| Sample | Formula | Result/Rating |
|---|---|---|
| 1 | Control/No Additive | 5 |
| 2 | Control/No Additive | 5 |
| 3 | Control/No Additive | 5 |
| 4 | Veinseal 14000 (5.00% B.O.S.) | 0 |
| 5 | Veinseal 14000 (5.00% B.O.S.) | 0 |
| 6 | Veinseal 14000 5.00% B.O.S.) | 1 |
| 7 | 02-050 (3.50% B.O.S.) | 0 |
| 8 | 02-050 (3.50% B.O.S.) | 0 |
| 9 | 02-050 (3.50% B.O.S.) | 0 |

The experiment demonstrates that re-formulation of the prior art Veinseal 14000, by raising the metallic oxide content and adjusting the ratios of the remaining active ingredients, can improve the overall cost and performance of the anti-veining additive by allowing the consumer to use up to 30.00% less material and achieve the same vein-free castings.

By increasing the metallic oxide level, the overall cost of the finished material, as compared to the Veinseal 14000 formulation, is reduced because a smaller amount of the more expensive lithia-containing material is needed to achieve vein-free castings. As demonstrated in the experiment, thermal expansion-related casting defects can be reduced or eliminated when the modified 02-050 formulation is used in foundry sand/resin systems at a level up to 30.00% less than the prior art formulations.

As demonstrated:

$$5.00\% \frac{3.50\%\ 02\text{-}050}{Veinseal\ 14000} \times 100 = 70.00\%$$

Therefore, using the 02-050 additive at 70.00% of the required amount of Veinseal 14000 achieves the same desired results, and there is a 30.00% reduction in required sand additive afforded the user or consumer.

Although the invention has been herein described in what is perceived to be the most practical and preferred embodiments, it is to be understood that the invention is not intended to be limited to the specific embodiments set forth above. Rather, it is recognized that modifications may be made by one of ordinary skill in the art of the invention without departing from the spirit or intent of the invention and, therefore, the invention it so be taken as including all reasonable equivalents to the subject matter of the appended claims and the description herein.

What is claimed is:

1. A material used to combat thermal expansion defects in silica sand foundry molds or cores, said material comprising:

52.75% spodumene;

22.75% black iron oxide;

5.00% red iron oxide; and 19.50% filler material.

2. The material of claim 1 wherein the filler material is ilmenite ($FeO—TiO_2$).

3. A method of making a metal casting from silica sand foundry molds or cores comprising the steps of:

preparing a mixture comprising at least about 80% by weight of silica sand, between about 0.5% to about 10% by weight of a binder, and at least about 3.0% by weight of a material used to combat thermal expansion defects, said material comprising 52.75% spodumene, 22.75% red iron oxide, 5.00% black iron oxide and 19.50% of a filler material;

shaping said mixture to form the sand mold or core having a desired pattern therein; and pouring molten metal into said pattern, allowing the molten metal to cool and harden, and removing the mold or core to produce a metal casting.

4. The method of claim 3 wherein the filler material is ilmenite ($FeO—TiO_2$).

* * * * *